US007157997B2

(12) United States Patent
Ohkubo et al.

(10) Patent No.: US 7,157,997 B2
(45) Date of Patent: Jan. 2, 2007

(54) ELECTROMAGNETIC CONTACTOR

(75) Inventors: Koji Ohkubo, Tokyo (JP); Mitsuhara Kasahara, Tokyo (JP); Hidehiko Ogawa, Tokyo (JP)

(73) Assignee: Fuji Electric Fa Components & Systems Co., Ltd., Tokyo (JP)

( * ) Notice: Subject to any disclaimer, the term of this patent is extended or adjusted under 35 U.S.C. 154(b) by 0 days.

(21) Appl. No.: 10/536,753

(22) PCT Filed: Sep. 19, 2003

(86) PCT No.: PCT/JP03/12010

§ 371 (c)(1),
(2), (4) Date: Nov. 4, 2005

(87) PCT Pub. No.: WO2004/049363

PCT Pub. Date: Jun. 10, 2004

(65) Prior Publication Data

US 2006/0152311 A1 Jul. 13, 2006

(30) Foreign Application Priority Data

Nov. 27, 2002 (JP) ..... 2002-343940

(51) Int. Cl.
*H01H 9/30* (2006.01)

(52) U.S. Cl. ..... 335/201; 335/132

(58) Field of Classification Search ..... 335/8–10, 335/132, 202, 201; 218/155–157
See application file for complete search history.

(56) References Cited

U.S. PATENT DOCUMENTS 6,037,555 A * 3/2000 Castonguay et al. ..... 218/157

FOREIGN PATENT DOCUMENTS

| | | |
|---|---|---|
| JP | 1-70224 | 5/1989 |
| JP | 1-70225 | 5/1989 |
| JP | 1-70226 | 5/1989 |
| JP | 1-73722 | 5/1989 |
| JP | 11-242924 | 9/1999 |

* cited by examiner

*Primary Examiner*—Ramon M. Barrera
(74) *Attorney, Agent, or Firm*—Rabin & Berdo, P.C.

(57) ABSTRACT

An electromagnetic contactor in which neighboring main contact points have an interphase barrier between them. A concave section is provided at the inner wall face of the interphase barrier at the middle of the emission path of the arc gas that is generated from the opening and closing of a main contact point. The concave section allows the arc gas passing from an arc generation point to an emission window to be accumulated in the concave section, which acts as a container, thus reducing the rate at which the arc gas is emitted. As a result, the amount of heat dispersed from the arc gas to the interphase barrier due to heat transfer is increased, thus reducing the temperature of the arc gas flowing from the emission window, which suppresses damage to the wiring cable that would otherwise occur due to excessive heating of the main terminal onto which the arc gas flows, and fusion of the interphase barrier.

3 Claims, 5 Drawing Sheets

ELECTROMAGNETIC CONTACTOR

BACKGROUND OF THE INVENTION

1. Technical Field

The present invention relates to an electromagnetic contactor used for opening or closing a motor circuit, for example, and more specifically, to the processing of emission arc gas caused when a contact point is opened or closed.

2. Prior Art

The processing of arc gas emissions in an electromagnetic contactor is disclosed, for example, in Japanese Laid Open Utility Model Publication No. 01-70228. Conventional examples will be described with reference to FIGS. 3 to 5. FIG. 3 is a longitudinal sectional view of a tripolar electromagnetic contactor. FIG. 4 is a perspective view of a power distribution part of the center pole of the electromagnetic contactor of FIG. 3, and FIG. 5 is a plan view of the main part of FIG. 4. With reference to FIGS. 3 to 5 (FIG. 3 in particular), the electromagnetic contactor has a main contact point 3 for a plurality of phases (three phases in the drawing), consisting of a pair of fixed contacts 1 opposed to each other, and a movable contact 2 for bridging the space therebetween. One end of each fixed contact 1 and both ends of the movable contact 2 are jointed with a fixed contact point 4 and a movable contact point 5, respectively. The other end of the fixed contact 1 is integrated with a main terminal 6. The mold case of the electromagnetic contactor consists of an upper frame 7 and a lower frame 8. The fixed contact 1 is pressed into the slot of the upper frame 7 from left and right in FIG. 3. The top part of the upper frame 7 is attached with an arc-suppressing cover 9 so as to cover the main contact point 3.

The movable contact 2 is inserted into a movable contact support 10 and is retained by a contact spring (compression coil spring) 11. The movable contact support 10 is guided to the upper frame 7 in a slidable manner in the longitudinal direction of FIG. 3 and is connected with a movable iron core 12. On the other hand, the lower frame 8 stores therein a fixed iron core 13 and an electromagnetic coil 14. A return spring 15, consisting of a compression coil spring for biasing the movable iron core 12 in the upper direction of FIG. 3, is inserted in the space between the electromagnetic coil 14 and the movable iron core 12. Reference numeral 16 denotes a coil terminal for connecting the electromagnetic coil 14 to an operation circuit (not shown).

In FIG. 4, the neighboring main contact points 3 have between them an interphase barrier 17 integrated with the upper frame 7 (only one side thereof is shown in FIG. 4). The front and rear parts of the main contact point 3 (are spaced from the main terminal 6 by a front and rear wall 18 of the arc-suppressing cover 9. As shown in FIG. 4 of the drawings, the front and rear wall 18 consists of the combination of a center part 18*a* having a "T"-shaped cross section and a left and right part 18*b* having a "J"-shaped cross section, between which an emission window 19 is provided, through which arc gas passes. An emission window 20 also is provided between the "J"-shaped part 18*b* and the interphase barrier 17 (the space extending to the side wall of the upper frame 7 for one side relative to the main contact point 3 for left and right poles).

In FIGS. 4 and 5, the inner wall face of the interphase barrier 17 (the inner wall face of the side wall of the upper frame 7 for one side relative to the main contact point 3 for left and right poles) includes a step in accordance with the outer end face of the arc-suppressing cover 18. The space in which the main terminal 6 is provided has an increased width between the left and right inner wall faces. As shown in FIG. 5, the width of the main terminal 6 is determined in accordance with the size of the above increased width between the inner wall faces, and the width of the fixed contact 1 integrated with the main terminal 6 has a narrower width than that of the main terminal 6. The vicinity of the root of the fixed contact 1 to the main terminal 6 is integrated with a pair of left and right attachment pieces 21 projecting in a hook-like manner. As already described, regarding the interphase barrier 17 partially shown in the perspective view of FIG. 5 (the side wall of the upper frame 7 for one side with regards to the main contact point 3 of left and right poles [the same applies to the following description]), the fixed contact 1 is pressed into the slot 22 via the attachment piece 21.

In FIG. 3, when the electromagnetic coil 14 is excited, the movable iron core 12 is attracted toward the fixed iron core 13 by the elastic force of the return spring 15. As a result, the movable contact 2 bridges the space between the fixed contacts 1 to close the power distribution path for each phase. Thereafter, when the electromagnetic coil 14 is demagnetized, the movable iron core 12 is returned to the position shown by the restoring force of the return spring 15 to open the power distribution path for each phase. When the opening or closing operation (the opening operation in particular) is performed, an arc is created between the fixed and movable contact points 4 and 5, which results in the mold resin (e.g., upper frame 7, movable contact support 10) being heated to a high temperature, and evaporating, thereby to create "arc gas." The resultant increase in internal pressure in the surrounding space of the main contact point 3, enclosed by the upper frame 7, the arc-suppressing cover 9, and the movable contact support 10, causes the arc gas to pass to the exterior via the emission windows 19 and 20, along the paths shown by the arrows in FIGS. 4 and 5.

This arc gas, which remains at a high temperature as it is passing through the emission window 20 in particular, flows along the planar inner wall face of the interphase barrier 17 or the side wall of the upper frame 7. As a result, the arc gas immediately reaches the emission window 20, while maintaining the high temperature, and therefore heats the attachment piece 21 and/or the main terminal 6. This can cause a problem in which, if the arc gas is emitted with a high frequency, the temperature of the main terminal 6 exceeds a certain limit, leading to damage of the wiring cable. The attachment piece 21 is also affected by the significant temperature increase, because the attachment piece 21 receives the arc gas leaving the emission window 20 first, and has a small size and a small heat capacity. This leads to melting of portions of the upper frame 7 in contact with the attachment piece 21. In this case, as the interphase barrier 17 is heated by both left and right sides, it may melt, which could result in interphase short-circuiting.

In view of the above, it is an objective of the present invention to reduce the temperature of the emission arc gas, which would thus prevent the temperature increase of the main terminal and the damage to the interphase barrier, for example.

SUMMARY OF THE INVENTION

In order to solve the above problem, the invention provides an electromagnetic contactor having a main contact point for a plurality of phases consisting of a pair of fixed contacts opposed to each other and a movable contact for bridging the space between them. The neighboring main contact points have therebetween an interphase barrier. An emission path for arc gas is created when the main contact point is opened or closed. The emission path has, at the middle thereof, a concave section provided at the inner wall face of the interphase barrier.

A conventional interphase barrier has an inner wall face that is flat and smooth and has no step. This causes arc gas to immediately flow to an emission window along this flat and smooth face. Thus, the present invention intends to reduce the rate at which the arc gas is emitted by configuring the inner wall face of the interphase barrier of the arc gas emission path to have a concave section at which the arc gas accumulates, thus impeding the flow of arc gas. This enables the arc gas to disperse to the interphase barrier an increased amount of its heat, before reaching the emission window, thus reducing the temperature of the arc gas flowing out of the emission window.

According to another feature of the invention, the concave section consists of a narrow groove perpendicular to the emission path of the arc gas. According to still another aspect of the invention, the inner wall face of the interphase barrier at the upstream side of the arc gas emission path is recessed from the downstream side so as to sandwich narrow groove forming the concave section. This allows the arc gas to enter the concave section in a smooth manner.

DETAILED DESCRIPTION OF THE PREFERRED EMBODIMENT

Figure 1:
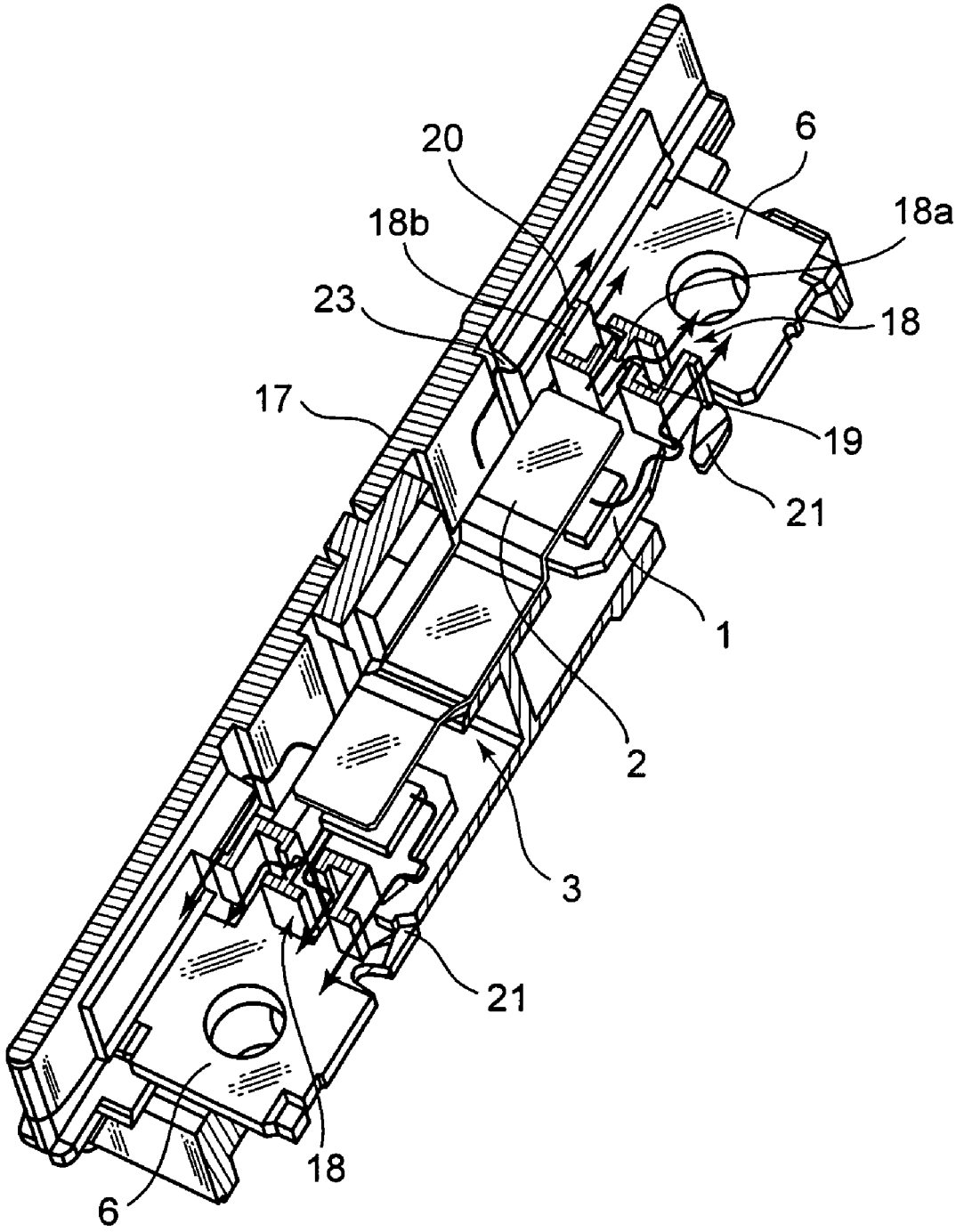
FIG. 1 is a perspective view of the power distribution part of the center pole of the electromagnetic contactor showing an embodiment of the present invention.
Figure 2:
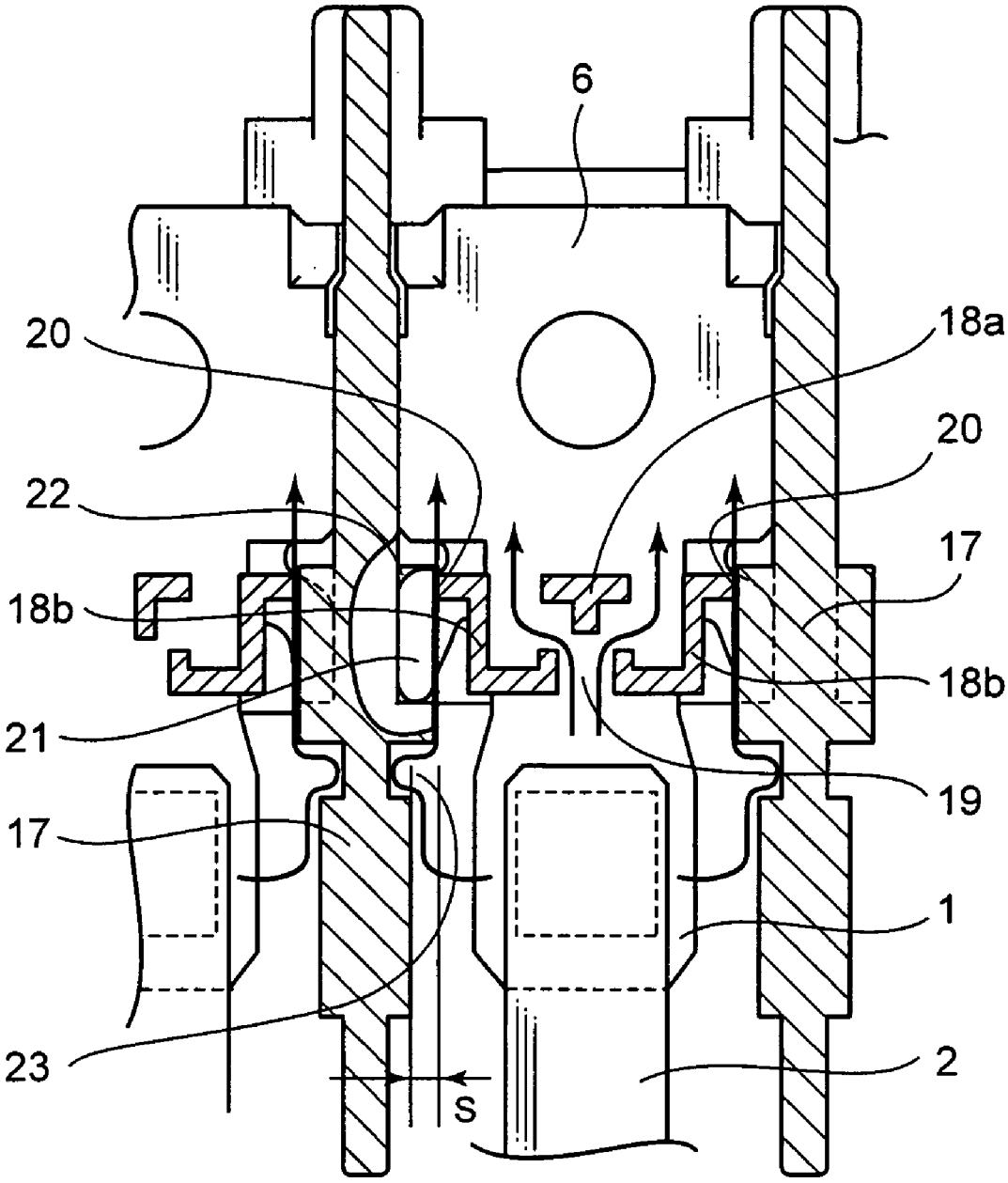
FIG. 2 is a plan view of the main part of FIG. 1.
Figure 3:
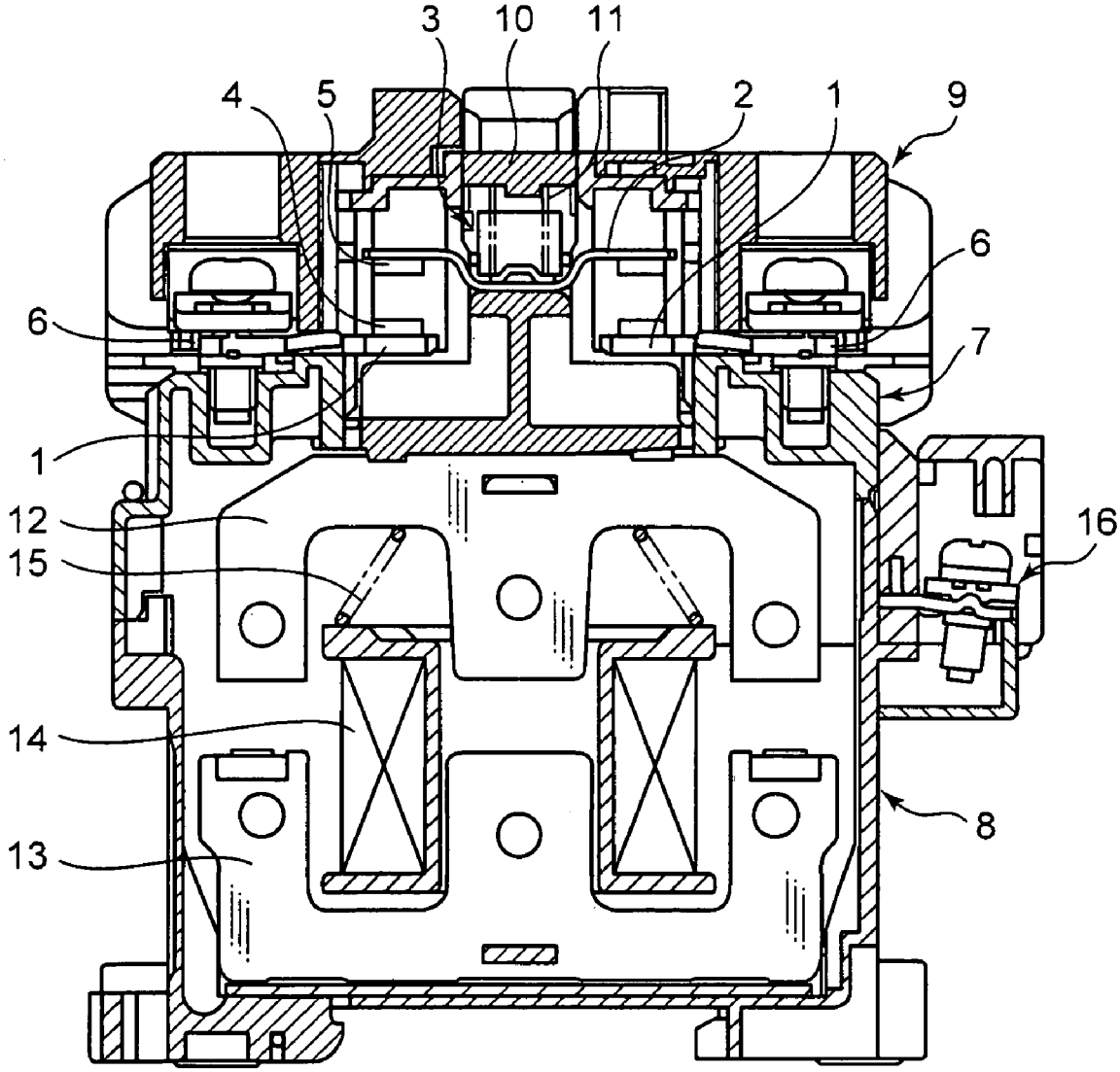
FIG. 3 PRIOR ART
FIG. 3 is a longitudinal sectional view of the electromagnetic contactor showing a conventional example.
Figure 4:
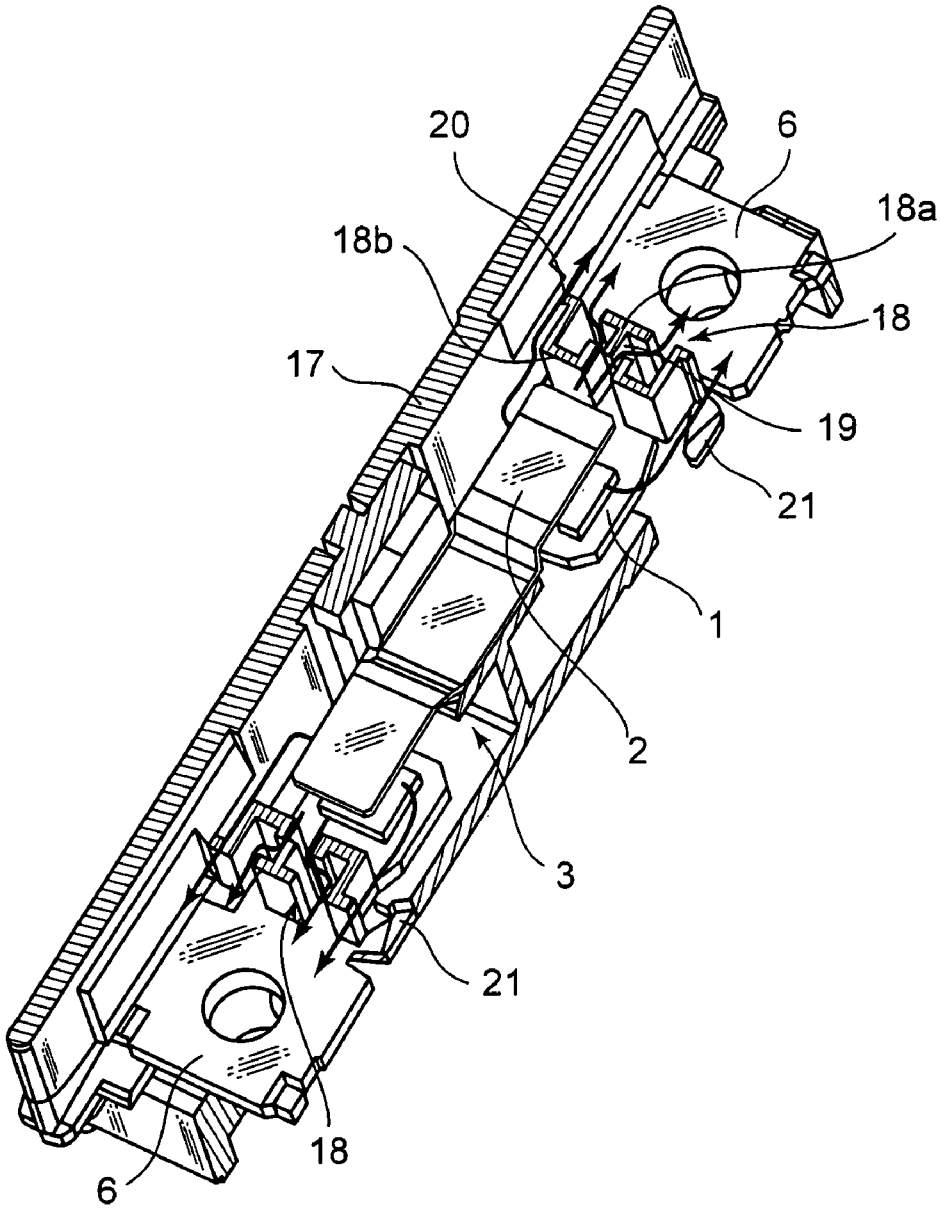
FIG. 4 PRIOR ART
FIG. 4 is a perspective view showing the power distribution part of the center pole of the electromagnetic contactor of FIG. 3.
Figure 5:
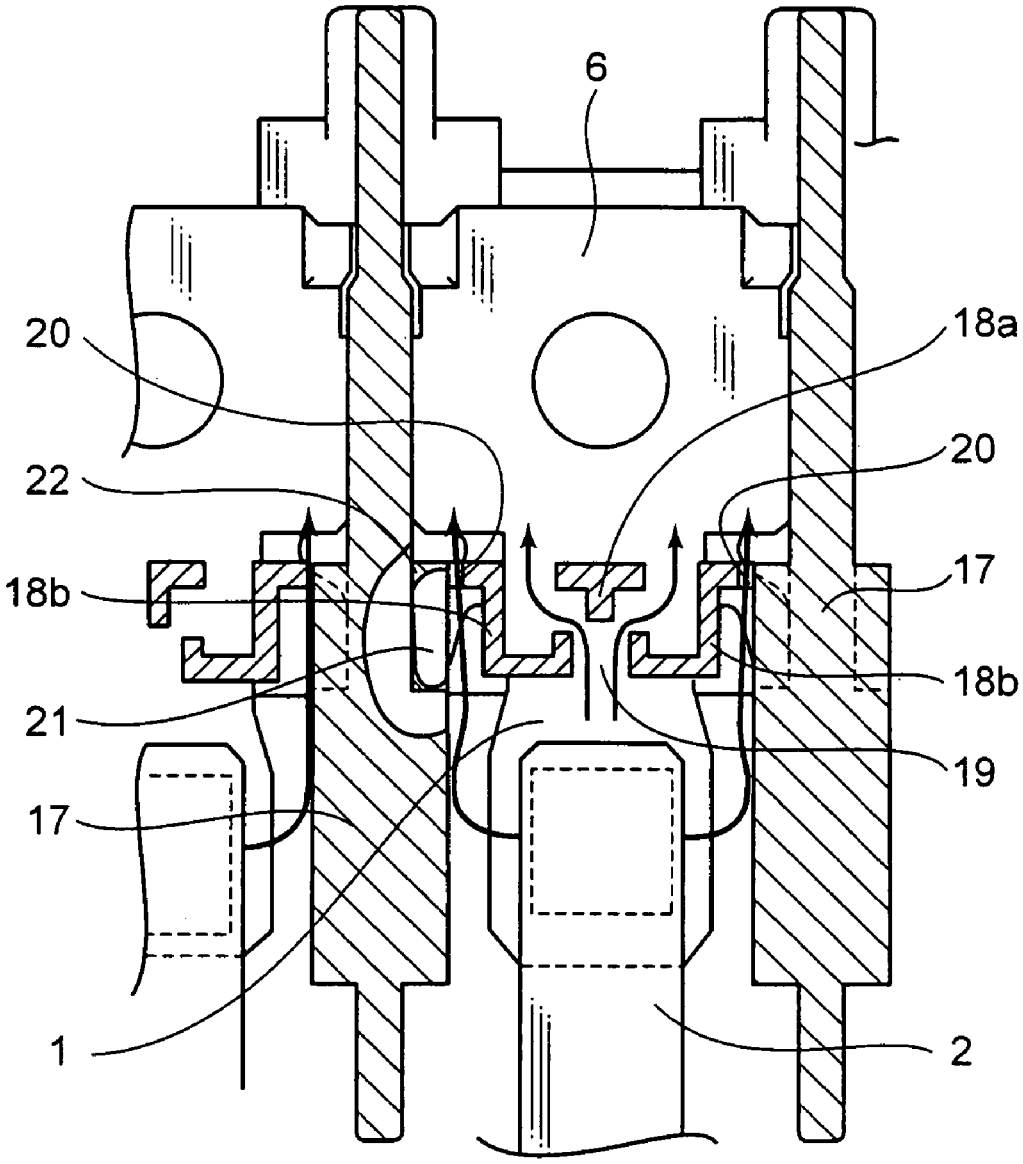
FIG. 5 PRIOR ART
FIG. 5 is a plan view of the main part of FIG. 4.

Hereinafter, with reference to FIG. 1 and FIG. 2, an embodiment of the present invention for an electromagnetic contactor shown in the conventional example will be described. FIG. 1 is a perspective view of a power distribution part of the center pole of the electromagnetic contactor. FIG. 2 is a plan view of the main part of FIG. 1. The components corresponding to those of the conventional example are designated with the same reference numerals. In FIGS. 1 and 2, the inner wall face of the interphase barrier 17 includes a concave section 23 at the middle of the arc gas emission path shown by the arrow. In the drawing, the concave section 23 includes a narrow groove extending perpendicularly to the emission path of the arc gas. The inner wall face of the interphase barrier 17 at the upstream side of the arc gas emission path is recessed from the face at the downstream side so as to sandwich the concave section 23. The upstream and downstream inner wall faces have between them a step S (FIG. 2).

In such an electromagnetic contactor, the arc gas flows along the interphase barrier 17 to be subsequently passed out from the emission window 20. This arc gas reaches the concave section 23 at the middle of the emission path from the arc generation point to the emission window 20 and enters this concave section 23 where it collects. Thereafter, the arc gas is pushed out to the emission window 20. This reduces the flow rate of the arc gas when compared to a case where the inner wall face has a planar shape. It also increases the amount of heat dispersed to the interphase barrier 17 through heat transfer. This in turn reduces the temperature of the arc gas emitted from the emission window 20, and thus suppresses damage to the wiring cable caused by an increase in temperature of the main terminal 6 and fusion of the interphase barrier 17 due to an excessively-heated fixed contact attachment piece 21, for example. The step S provided at the front and rear parts of the concave section 23 allows the arc gas to enter the concave section 23 more easily. Thus, this step S makes it possible to adjust, by the size thereof, the time during which the arc gas accumulates. However, the step S is not always required, and the front and rear parts of the concave section 23 may be of the same level. The shape of the concave section 23 is not limited to the narrow groove and may have a square concave shape or a circular concave shape, for example.

INDUSTRIAL APPLICABILITY

As described above, the present invention provides a concave section that works as a container in which the arc gas can accumulate at the middle of the emission path of the arc gas at the inner wall face of the interphase barrier of the main contact point. This makes it possible to appropriately suppress the temperature of the arc gas passing out through the emission window to the main terminal, thus preventing damage to the wiring cable due to an excessively heated main terminal, and interphase short-circuiting caused by the fusion of the interphase barrier, for example.

The invention claimed is:

1. An electromagnetic contactor, comprising:

a plurality of main contact points, each for one of a plurality of phases, and each including a pair of fixed contacts opposed to each other and a movable contact for bridging the space therebetween, wherein at least two of said plurality of main contact points are disposed adjacent to one another and have therebetween an interphase barrier, and an emission path along an inner wall face of said interphase barrier for arc gas created when a main contact point of said plurality of main contact points is opened or closed, the emission path having, upstream of an emission window, a concave section at the inner wall face of the interphase barrier.

2. An electromagnetic contactor comprising:

a plurality of main contact points, each for one of a plurality of phases, and each including a pair of fixed contacts opposed to each other and a movable contact for bridging the space therebetween, wherein at least two of said plurality of main contact points are disposed adjacent to one another and have therebetween an interphase barrier, and an emission path along an inner wall face of said interphase barrier for arc gas created when a main contact point of said plurality of main contact points is opened or closed, the emission path having, upstream of an emission window, a concave section at the inner wall face of the interphase barrier, wherein the concave section consists of a narrow groove perpendicular to the emission path of the arc gas.

3. An electromagnetic contactor according to claim 2 wherein the inner wall face of the interphase barrier at an upstream side of the concave portion is recessed from the inner wall face at a downstream side thereof.

* * * * *